US005967139A

United States Patent [19]

Hussong

[11] Patent Number: 5,967,139

[45] Date of Patent: Oct. 19, 1999

[54] GAS BURNING FIREPLACE UNIT WITH DAMPER

[75] Inventor: Dudley D. Hussong, Lakefield, Minn.

[73] Assignee: Hussong Manufacturing Co., Inc., Lakefield, Minn.

[21] Appl. No.: 08/926,793

[22] Filed: Sep. 10, 1997

Related U.S. Application Data

[63] Continuation-in-part of application No. 08/688,604, Jul. 30, 1996, abandoned.

[51] Int. Cl.[6] ..... F24B 1/189

[52] U.S. Cl. ..... 126/529; 126/338; 126/534; 126/285 A

[58] Field of Search ..... 126/538, 539, 126/512, 528, 529, 289, 285 A, 83, 80, 533, 534, 535, 536

[56] References Cited

U.S. PATENT DOCUMENTS

| | | | |
|---|---|---|---|
| 4,191,162 | 3/1980 | Simms | 126/529 |
| 4,192,285 | 3/1980 | Nietapski | 126/83 |
| 4,461,273 | 7/1984 | Barker et al. | 126/77 |
| 4,465,055 | 8/1984 | Bortz | 126/534 |
| 4,658,801 | 4/1987 | Black | 126/83 X |
| 5,267,552 | 12/1993 | Squires et al. | 126/512 |
| 5,307,801 | 5/1994 | Schroeter et al. | 126/515 |
| 5,450,841 | 9/1995 | Whitaker et al. | 126/512 |
| 5,452,708 | 9/1995 | Shimek et al. | 126/512 |
| 5,647,342 | 7/1997 | Jamieson etal. | 126/512 |
| 5,669,374 | 9/1997 | Valters et al. | 126/512 |

FOREIGN PATENT DOCUMENTS

| | | | |
|---|---|---|---|
| 47565 | 3/1982 | European Pat. Off. | 126/512 |

*Primary Examiner*—Ira S. Lazarus
*Assistant Examiner*—Sara Raab
*Attorney, Agent, or Firm*—Westman, Champlin & Kelly, P.A.

[57] ABSTRACT

A gas fireplace unit has a combustion chamber in which a gas burner is provided as a heat source, and the gas fireplace unit has a heat exchanger on an upper wall of the combustion chamber. A first set of ports pass through the upper wall into the combustion chamber at a position wherein they are offset from the axis of an exhaust pipe that opens to the heat exchanger. A second set comprising a port or ports is provided aligned with the exhaust pipe, and a damper is mounted to be controllable to cover or uncover the second set from the exterior of the gas fireplace unit. The damper will permit hot gases from the burner to either be directly exhausted out the second set to the exhaust pipe, or when the damper is closed cause hot gasses to be exhausted only through the first set of ports, which provides a greater heat exchange path.

14 Claims, 5 Drawing Sheets

GAS BURNING FIREPLACE UNIT WITH DAMPER

CROSS REFERENCE TO RELATED APPLICATION

This application is a continuation-in-part of my application Ser. No. 08/688,604, filed Jul. 30, 1996 now abandoned, the disclosure of which is hereby incorporated by reference.

BACKGROUND OF THE INVENTION

The present invention relates to a gas burning fireplace unit that can be used either as an efficient heat source, or as a decorative fireplace with low heat output if heat is not required.

Direct vent fireplaces are known, and they have a passage for fresh air into the fireplace combustion chamber. A gas burner provides a heat source as well as decorative flames when desired, and an exhaust stack is provided for an exit of gases from the combustion chamber. The burners can be either natural gas or L.P. gas, and the direct vent units are normally installed permanently in a home and include wiring for powering a fan that may be provided for moving heated air through the room.

Conventional on/off valves, gas safety valves, and if desired, an airtight gas front glass are provided. However, during warmer temperatures, gas fireplaces, even though attractive and providing a pleasant glow to a room, have not been used regularly because they are an unwanted heat source.

SUMMARY OF THE INVENTION

The present invention relates to a fireplace unit that can be used as a heat source, but has a heat exchanger arranged so that upon opening a damper, the majority of the heat is directly exhausted out the exhaust stack of the unit so that it does not cause substantial heat to be transferred into the room.

The fireplace unit of the present invention can use a conventional gas burner, and a conventional direct vent arrangement, but utilizes a unique heat exchanger which includes one or more exhaust ports aligned directly with the exhaust pipe, and of size so a majority of the hot combustion gases do not circulate before being exhausted. A damper will cover the exhaust port or ports in a selected position so that the hot gases exit the combustion chamber and flow into the heat exchanger through ports positioned to cause a greater exchange of heat as the hot gases flow to the exhaust pipe.

In the form shown, the heat exchanger is on the top wall of the fireplace, and there is a centrally located exhaust pipe exiting the heat exchanger.

As shown, the upper wall of the combustion chamber is inclined from the vertical and horizontal, so that it overlies at least a portion of the burner below it. The upper wall has a surface open to the combustion chamber wall and has ports at different locations leading into the heat exchanger. A first set of ports comprises at least one port or a plurality of ports that are offset laterally from the central axis of the exhaust pipe, so that the hot gases passing from the first set of ports into the heat exchanger have to flow around and over surfaces of the heat exchanger and provide a greater exchange of heat into the passageways that carry room air. The first set of ports remain open so there is always an exit path for combustion gases.

A second port set which may be a single large port or several ports, is aligned directly with the exhaust pipe, and may be of larger size than the first set of ports. A damper is provided on the heat exchanger and it can be mounted to be movable from a position where the second set comprising a port or ports is uncovered to a position where the second set is covered and the damper blocks gas flow through the second set into the heat exchanger. When the second set is covered, the hot gases have to flow through the first set of ports to provide a substantial heat source for the room. When the second set is uncovered, the hot gases escape directly into the exhaust pipe, reducing the heat transfer to the wall surfaces of the heat exchanger and thus to room air passageways or ducts ad into the room.

The second set comprising a port or ports is controlled by a damper, and can be arranged as desired, and the port or ports can be of any desired size, but are configured so that they will cause a substantial portion of the gases to flow therethrough directly into the exhaust pipe when the damper is in open position. This accomplishes the purpose of having the decorative effects of a fireplace without having a substantial heating effect so that the fireplace use in warmer temperatures is acceptable.

The damper may be a plate that slides along a wall to cover or uncover one or more ports or a butterfly damper covering a single port that will pivot from open to closed positions.

The direct vent fireplace having the present improvement thus has a higher use factor and fulfills more functions, including a function of providing an efficient heat source, and when selected, a function of providing an attractive low heat output fireplace configuration.

DETAILED DESCRIPTION OF THE PREFERRED EMBODIMENTS

Figure 2:
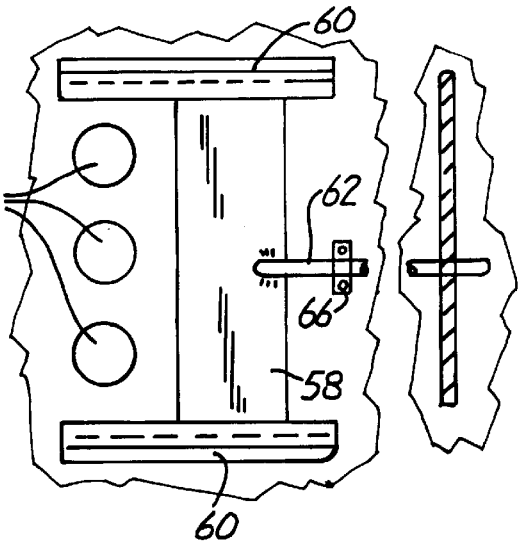
FIG. 2 is a front sectional view of the fireplace unit of FIG. 1.
Figure 3:
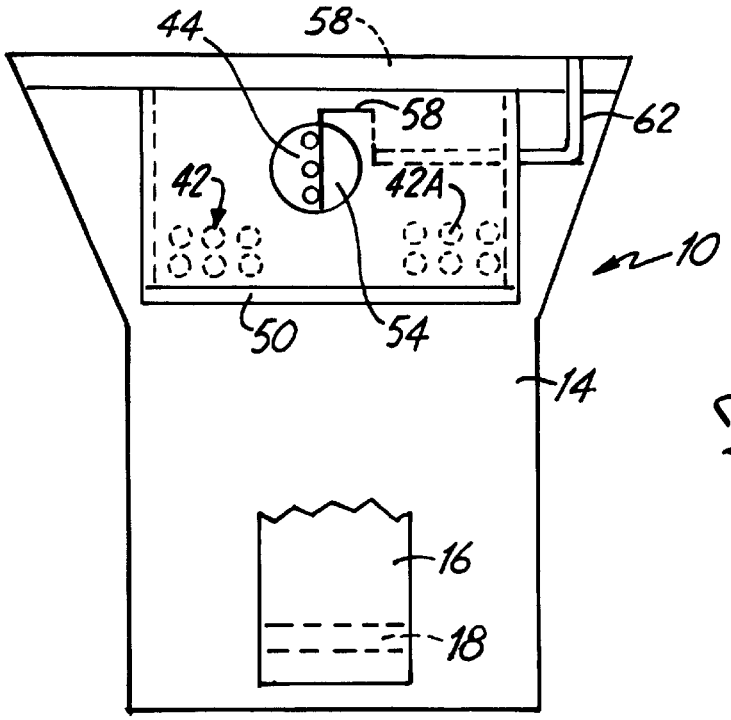
FIG. 3 is a fragmentary rear view taken generally along line 3—3 in FIG. 1.
Figure 4:
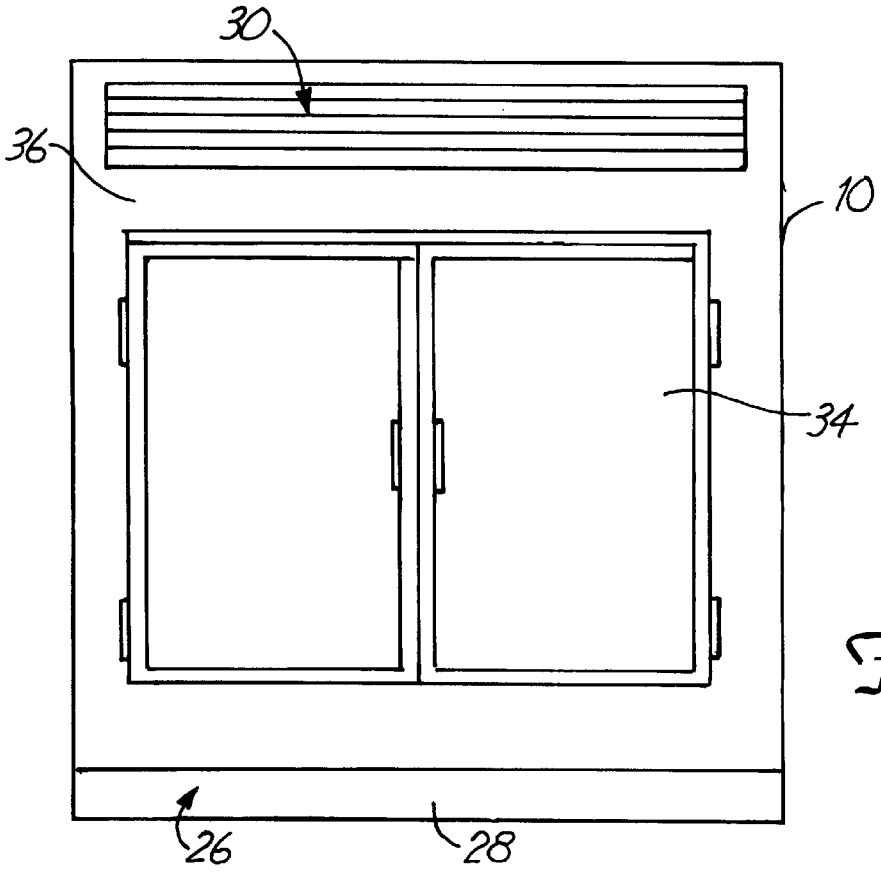
FIG. 4 is a front view of the unit of FIG. 1.

A fireplace unit indicated generally at 10 substantially incorporates conventional components. It is of the type that is permanently installed in a home. It includes a combustion chamber 11 that has front and rear walls 36 and 14, and a sloping top wall 12 that span across the width of the fireplace as shown in FIGS. 2 and 3.

The rear wall indicated at 14 has a fresh air plenum and intake passageway 16 mounted on the rear wall that opens through an opening 18 for fresh outside air for providing combustion air to a burner 20 of conventional design, which is shown only schematically. Suitable burner controls 22 are provided to control gas from a source 23, which can be natural gas or L.P. gas. As schematically shown artificial glow logs 24 also can be provided on the burner.

The fireplace unit can be mounted in an outer housing that provides for room air ducts 26 of conventional design, and which are shown only schematically. The lower room air duct 28 is the intake duct, and the room air can be forced across the heated surfaces of the walls of the combustion chamber with circulating air discharged out through a top duct 30. A fan can be provided for moving room air through these ducts.

Suitable glass fireplace doors 34 can be provided in the front wall 36 if desired as well.

The burner 20 operates in a conventional manner, with fresh air coming in through the plenum ring 38, which surrounds an exhaust pipe 40, and through the duct 16 to provide combustion air for the burner.

The top wall 12 is provided with at least two distinct sets of ports, including a first set of ports shown at 42, and 42A, which comprise the first set of ports. These ports are positioned as shown in FIG. 2 to one or both lateral sides of the center of the fireplace, and thus to the lateral sides of the exhaust pipe, which is located in the transverse center of the fireplace unit. The top wall 12 also has a second set of ports shown at 44, as shown a plurality of ports forming a direct exhaust opening, which are relatively large, and are directly aligned with the exhaust pipe 40. These ports 42, 42A and 44 open from the combustion chamber into a heat exchanger plenum chamber 50, which is formed to be substantially rectangular. As can be seen in FIG. 3 the plenum extends to near the edges of the sloping top wall 12.

The exhaust pipe 40 is connected to an exhaust port 54 that is positioned in direct alignment with the exhaust ports 44 forming the second set, and the exhaust ports 42 and 42A are offset from the central axis of the exhaust pipe 40, not only laterally but also in direction toward the rear wall 14, so that the ports 42 and 42A are not directly aligned with the exhaust pipe.

Figure 1:
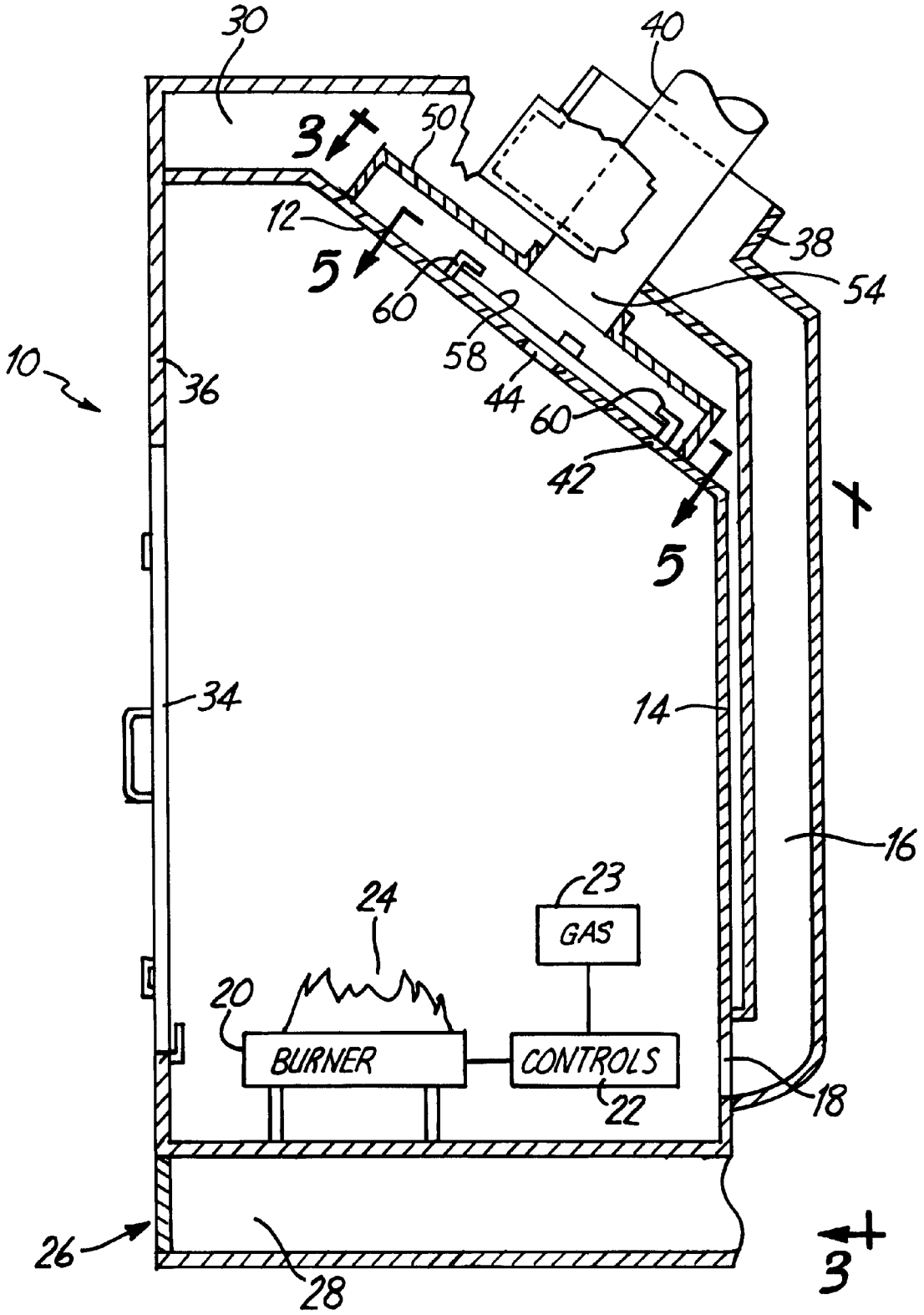
FIG. 1 is a schematic side elevational view of a fireplace unit made according to the present invention with parts in sections and parts broken away.
Figure 5:
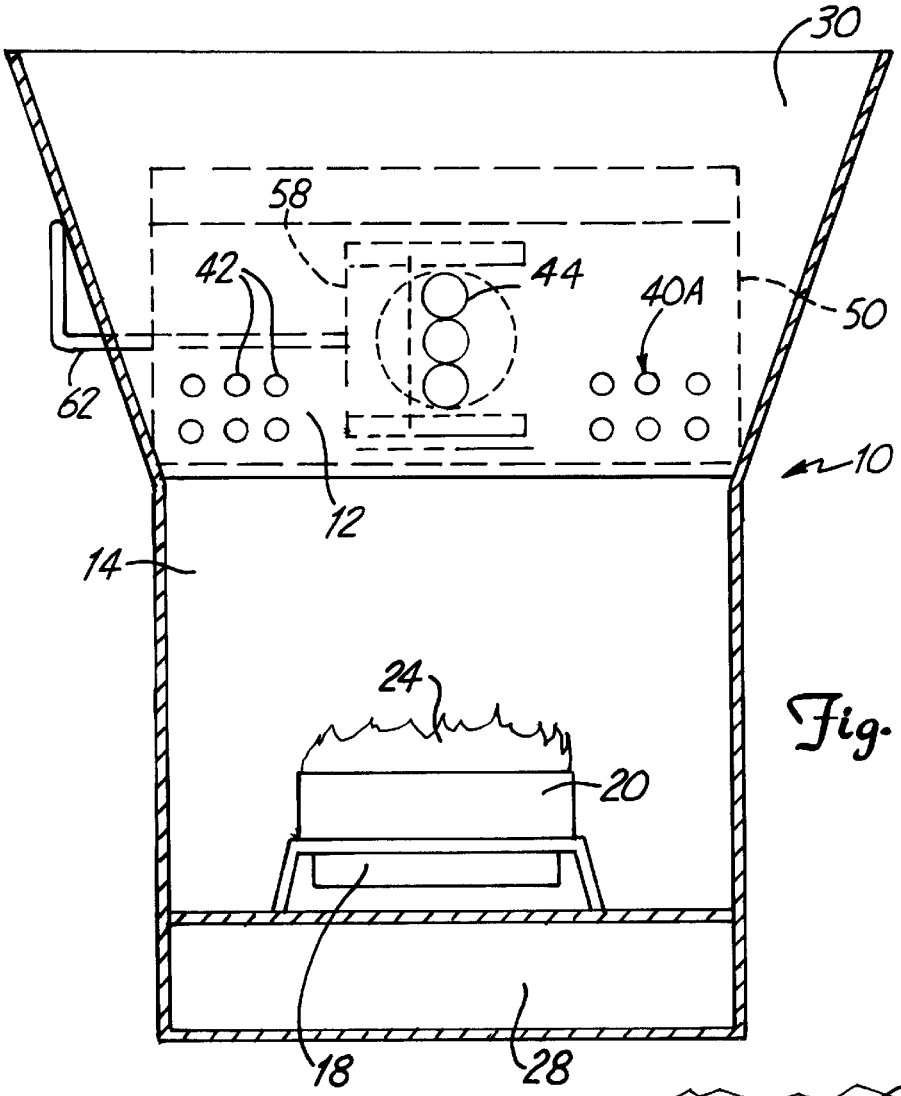
FIG. 5 is a fragmentary enlarged view taken as on line 5—5 in FIG. 1.

In the first form of the invention, a sliding damper plate 58 is mounted in suitable track members 60 at the top and bottom, and is connected to a damper handle 62, which can be slidably mounted in suitable guides 64 and extend out through a sidewall of the plenum chamber utilizing a suitable known seal. The damper plate 58 will slide from a position shown in solid lines in FIG. 5, and in dotted lines in FIG. 2, to a position where it overlies the second set of ports 44, as shown again by dotted lines in FIG. 5. This is done by sliding the damper handle 62 transversely of the heat exchanger. When the damper plate 58 covers the ports 44 forming an exhaust opening, the hot gases from the burner must go into the heat exchanger through the first set of ports 42, and 42A which increases the path that the hot gases have to travel in engagement with the heat exchanger surfaces.

While the heat exchanger is shown quite schematically, it can have any known type of baffling desired, to enhance the effect of the hot gases passing from the ports 42 and 42A to the exhaust pipe 40 when the fireplace unit is intended to be used as a heat source.

In warmer temperatures, when the fireplace unit is intended to be a decorative or mood enhancing display of fire, the damper plate 58 is moved laterally to uncover the ports 44 forming an exhaust opening and the hot gases from the burner 20 will discharge substantially directly out the exhaust pipe 40 so that there is little heat exchange with the exhaust gases. Also, the room air circulating fan would not be used during the time when the fireplace unit is intended to be merely decorative.

While a specific form of fireplace unit has been illustrated, it is to be understood that the heat exchanger is open to a combustion chamber of a gas fireplace, and is used with a damper which when closed causes gases to be discharged through an efficient heat exchange path. When the damper is open it provides a substantially straight path for the hot gases to pass into the exhaust pipe.

The type of damper can be varied. It can be a swinging or pivoting plate, or a butterfly damper as well as the sliding plate that would slide in either direction.

Figure 6:
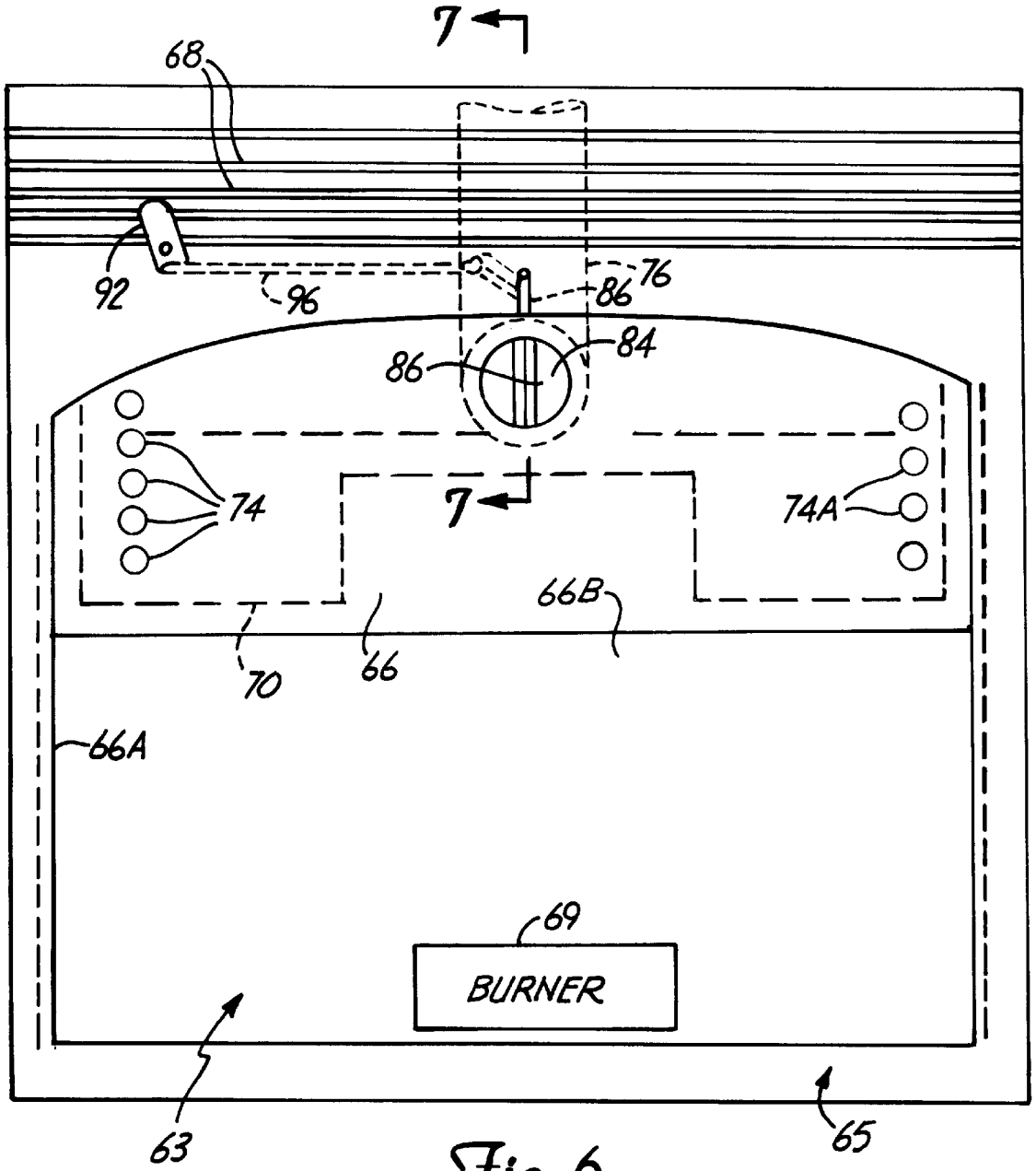
FIG. 6 is a front view of a fireplace having a modified form of the present invention.
Figure 7:
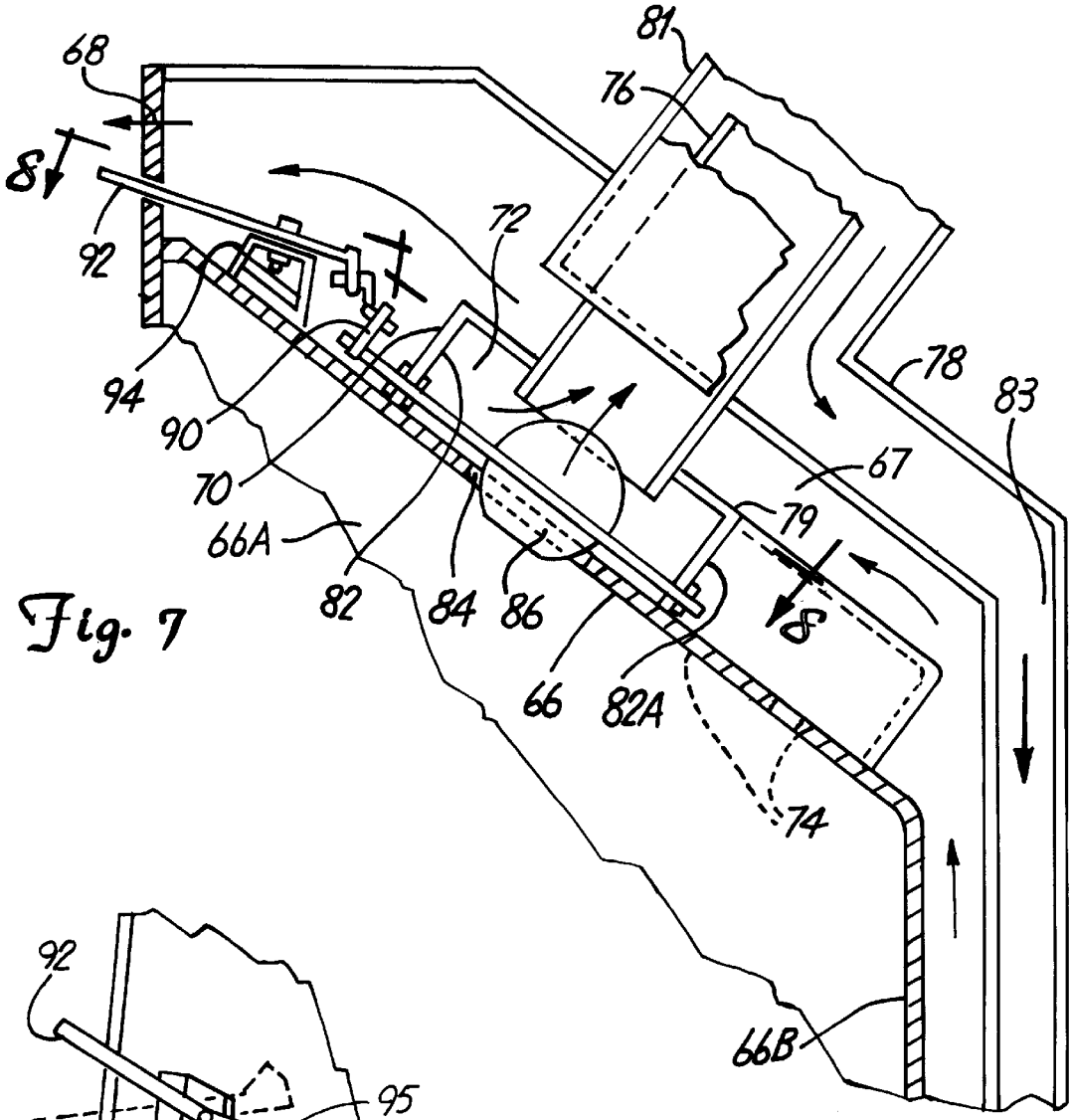
FIG. 7 is a sectional view taken on line 7—7 in FIG. 6.
Figure 8:
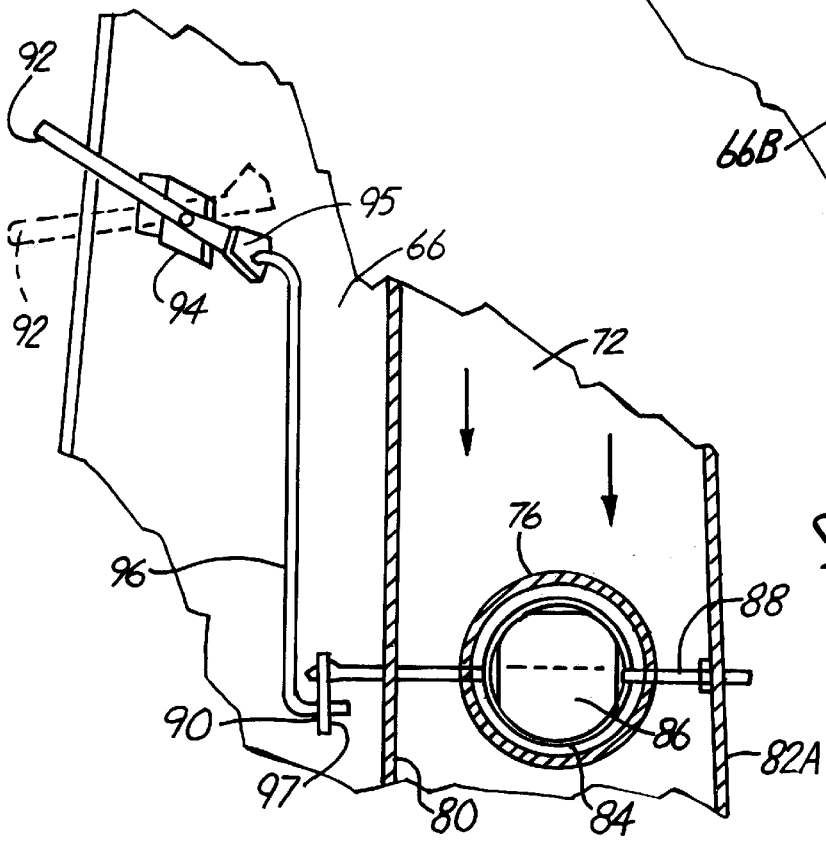
FIG. 8 is a schematic representation of a linkage taken on line 8—8 in FIG. 7.

FIGS. 6, 7 and 8 illustrate schematically a modified damper, comprising the butterfly damper as mentioned above.

When a butterfly damper is used, a single exhaust opening from the combustion chamber utilized, which is in alignment with the exhaust pipe. The butterfly damper then pivots from open to closed position to cover and uncover that opening in a known manner. In this form of the invention, a gas fireplace shown only schematically and partially at 65 includes a combustion chamber 63 in which a burner 69, shown schematically, is mounted. The combustion chamber includes a top wall 66 and side and rear walls 66A and 66B. The fireplace is provided with an air circulation chamber for room air as previously described for circulating room air from a duct 67 through louvers 68 as previously explained, past a heat exchanger section 70 (FIG. 7). It should be noted that the heat exchanger section 70 is shown protruding into the duct 67, but top wall 66 could be formed so that the heat exchanger essentially is positioned below the plane of the top wall 66.

In this form of the invention, the top wall 66 has a first set of ports 74 and 74A along opposite side edges of the heat exchanger. These ports 74 and 74A open into a heat exchanger chamber 72, but they are laterally offset from the center plane of the fireplace, and thus laterally offset from an exhaust pipe 76, which is represented in dotted lines in FIG. 6 and is shown in FIG. 7. The exhaust pipe 76 passes through an upper wall 78 of the gas fireplace unit. A fresh air intake pipe 81 surrounds the exhaust pipe 76 for providing fresh combustion air to the burner through a passage 83, in a known manner.

Exhaust pipe 76 passes through a top wall 78 of the gas fireplace and also opens through the wall 79 of the heat exchanger 70. The heat exchanger 70 has walls which enclose the ports 74, 74A.

The interior chamber 72 of the heat exchanger 70 has a first exhaust opening or port set 84 leading from the combustion chamber 63 into the heat exchanger chamber 72. A butterfly plate valve 86 is fixed to a support shaft 88 that extends across the center section of the heat exchanger chamber and is pivotally mounted in walls 82 and 82A forming front and rear walls of the center section of the heat exchanger. The shaft 88 extends outwardly on a front or upper wall 82 of the heat exchanger, as shown toward the front of the fireplace. Shaft 88 has an actuator arm 90 drivably mounted on the shaft, on the exterior of the heat exchanger 70. The shaft 88 pivotally passes through the heat exchanger walls 82 and 82A and can have suitable seals to prevent combustion gasses from escaping are provided.

The arm 90 is controlled by an exterior lever 92 that is pivotally mounted on a bracket 94 fixed to the top wall 66 of the combustion chamber of the gas fireplace. As shown the lever 92 passes through the louvers or grill 68. The lever 92 has an inner end that pivotally connects at 95 to one end of a link 96, and the opposite end 97 of the link 96 pivotally mounts to an outer end of the arm 90, as shown schematically. Upon pivoting the lever 92 by moving an end that extends slightly out from the louvers, the arm 90 will be moved and the shaft 88 and butterfly valve 86 will be rotated so that it overlies opening 82 to block the opening, as shown in FIG. 8. As shown in FIGS. 6 and 7, the butterfly valve 86 can be moved to an open position where the plane of the butterfly damper or valve is substantially perpendicular to the wall 66 and parallel to the central axis of the exhaust pipe 76. The valve 86 is shaped to permit this pivoting and blocking substantial flow of hot gasses directly into the exhaust pipe.

Since the exhaust pipe 76 and the opening 86 are substantially axially aligned, in the open position of the butterfly valve 86, exhaust gasses will pass substantially directly out through the exhaust port or opening 84 forming a second set, and out through the exhaust pipe 76. Little heat is retained or exchanged by the heat exchanger 70 with the butterfly valve 84 in the open position, in the same manner as explained in relation to the first form of the invention.

Upon closing the butterfly valve 86, and blocking substantial flow through the opening 84, exhaust gasses from the combustion chamber 63 are forced to pass through the first set of ports comprising at least one laterally offset port, and as shown, a plurality of ports 74 and 74A. This causes the exhaust gas to travel a longer distance along heat conductive surfaces that are used for heat exchange. The exhaust gasses flow out the exhaust pipe 76. The offset of the second set of ports provides heat exchange so that the room heating efficiency of the fireplace is increased and heat output to the room is provided.

Again the second form of the invention is a damper that blocks or opens an exhaust opening directly aligned with the exhaust pipe so that there is substantially a direct flow of exhaust gasses from the combustion chamber into the exhaust pipe when the damper is open.

Any suitable linkage for operating the butterfly valve can be used, and the linkage is made to have enough drag to prevent the valve from coming open unintentionally. The butterfly valve can move so it is partially through opening 84 when the valve is opened and may also extend partially into the exhaust pipe.

Although the present invention has been described with reference to preferred embodiments, workers skilled in the art will recognize that changes may be made in form and detail without departing from the spirit and scope of the invention.

What is claimed is:

1. A gas fireplace unit comprising a wall forming a combustion chamber, a burner in the combustion chamber for producing heated gases, and a heat exchanger connected to the combustion chamber through ports in the wall of the combustion chamber said heat exchanger including an exhaust pipe opening in a heat exchanger wall spaced from the combustion chamber wall, and said combustion chamber wall having at least one first outlet port oriented so that hot gases passing therethrough are offset from the exhaust pipe opening when gases from the combustion chamber enter the heat exchanger, and at least one second outlet port in the combustion chamber wall in alignment with the exhaust pipe opening sufficient for substantially direct flow of the hot gases from the at least one second outlet port through the exhaust pipe, and a damper for controlling the substantially direct flow through said at least one second outlet port to selectively alter the exhaust gas flow patterns of the gas fireplace.

2. The gas fireplace of claim 1, wherein said wall of the combustion chamber is an upper wall, which inclines to be over at least a portion of the burner in the combustion chamber.

3. The gas fireplace of claim 1, wherein said exhaust pipe opening is in the heat exchanger wall, and the combustion chamber wall is the upper wall of the combustion chamber, the heat exchanger wall being parallel to the combustion chamber wall.

4. The gas fireplace of claim 1, wherein said at least one second outlet port comprises a plurality of ports forming a second set of ports aligned with the exhaust port, and said damper comprising a flat damper plate slidably mounted on a surface of an upper wall of the combustion chamber, the damper plate being movable between a position covering the second set of ports and a position uncovering the second set of ports.

5. The gas fireplace unit of claim 4, including a handle on the exterior of the heat exchange unit for moving the damper plate between the damper plate positions.

6. A gas fireplace unit comprising a combustion chamber having an upper wall, side walls joining the upper wall, a rear wall joining the side walls, and a front wall joining the side walls and spaced from the rear wall for viewing an interior of the combustion chamber, an air flow chamber at least in part surrounding the combustion chamber for providing a discharge of heated air into a room, said air flow chamber including a portion wall of the combustion chamber having exhaust gas ports therein, an exhaust chamber being formed at least in part by a portion of the wall of the combustion chamber having the exhaust ports, an exhaust pipe for discharging products of combustion open through an exhaust pipe opening to the exhaust chamber on a side thereof opposite and spaced from the wall having the exhaust ports, the exhaust chamber having wall surfaces larger than the exhaust pipe opening for conducting heat to air flowing in the air flow chamber, and a damper for blocking flow through at least one of said ports from the combustion chamber to the exhaust chamber to alter the heat exchange patterns of the gas fireplace.

7. The gas fireplace of claim 6, wherein the upper wall of the combustion chamber includes an inclined portion that overlies at least a portion of a burner in a combustion chamber, said ports being formed in said inclined wall portion.

8. The gas fireplace of claim 6, wherein said ports includes at least one port substantially aligned with the exhaust pipe, and said damper being positioned to selectively cover and uncover said at least one aligned port.

9. The gas fireplace of claim 6, wherein said damper operates to cover and uncover only selected ports, the rest of the ports being unaffected by movement of the damper.

10. The gas fireplace of claim 6, wherein the ports include first ports and second ports, the first ports being offset from the exhaust pipe opening, said second ports being separated from said first ports, said damper operating only in conjunction with said second ports.

11. A gas fireplace unit comprising a combustion chamber having side walls, a rear wall, and an upper wall assembly joined together to form the chamber, a burner in the combustion chamber producing heated exhaust gases, an exhaust pipe for carrying exhaust gases from the combustion chamber, the upper wall assembly comprising two spaced walls, including an outer wall and an inner wall, the exhaust pipe being coupled to an exhaust pipe opening through the outer wall and being spaced from the inner wall, the inner wall being larger than the exhaust pipe opening, said heat exchanger chamber providing a heat exchange surface, said heat exchanger chamber having a surface area larger than the exhaust pipe opening, a plurality of first openings from the combustion chamber to the exhaust pipe including an alternate opening in the inner wall in alignment for direct flow of gases from the combustion chamber to the exhaust pipe a damper movable to control flow through the alternate opening in the inner wall, at least one of the plurality of first openings, other than the alternate opening being offset from a central axis of said exhaust pipe opening and remaining constantly open so the distance of travel of exhaust gases from the at least one opening to the exhaust pipe opening is greater than the path of travel from the alternate opening to the exhaust pipe opening.

12. The gas fireplace of claim 11, wherein the inner wall of said combustion chamber has said plurality of openings and is an upper wall of the combustion chamber.

13. In a gas fireplace having a combustion chamber with side, upper and rear walls, a duct around at least portions of the walls including the upper wall for providing heated air into an exterior space, an exhaust pipe fluidly coupled to the combustion chamber, and a gas burner in said combustion chamber providing heated gases to transfer heat to air in the duct, and the heated gases flowing from the combustion chamber to the exhaust pipe, the method of controlling heat transferred to air in the duct comprising providing a first wall with a first opening from the combustion chamber aligned with the exhaust pipe, providing a second exhaust opening from the combustion chamber laterally offset from the exhaust pipe, selectively controlling flow of heated gases through the first opening to change the length of the path of travel for some heated gases into the exhaust pipe to control the amount of heat transferred to air in the duct.

14. The method of claim 13 including the step of providing continuous flow through the second exhaust opening leading from the combustion chamber.

* * * * *

UNITED STATES PATENT AND TRADEMARK OFFICE

CERTIFICATE OF CORRECTION

PATENT NO. : 5,967,139

DATED : October 19, 1999

INVENTOR(S) : Dudley D. Hussong

It is certified that error appears in the above-identified patent and that said Letters Patent is hereby corrected as shown below:

Claim 1, line 5, insert --,-- after "chamber".

Claim 6, line 8, after "portion" insert --of a--.

Claim 6, line 12, delete "open" and insert --opening--.

Claim 6, line 18, after "said" insert --exhaust--.

Claim 7, line 3, delete "a" and insert --the--.

Claim 11, line 10, delete "said" and insert --a--.

Claim 11, line 16, after "pipe" insert --,--.

Signed and Sealed this

Nineteenth Day of December, 2000

*Attest:*

*Attesting Officer*

Q. TODD DICKINSON

*Commissioner of Patents and Trademarks*